US011363930B2

(12) United States Patent
Gilbert et al.

(10) Patent No.: US 11,363,930 B2
(45) Date of Patent: Jun. 21, 2022

(54) BATTERY POWERED VACUUM CLEANER

(71) Applicant: Techtronic Cordless GP, Anderson, SC (US)

(72) Inventors: Christopher Gilbert, Harrisburg, NC (US); Kevin Thomas, Indian Trail, NC (US); William Jacob Kozlowski, Jr., Waxhaw, NC (US)

(73) Assignee: Techtronic Cordless GP, Anderson, SC (US)

( * ) Notice: Subject to any disclaimer, the term of this patent is extended or adjusted under 35 U.S.C. 154(b) by 58 days.

(21) Appl. No.: 16/786,419

(22) Filed: Feb. 10, 2020

(65) Prior Publication Data

US 2020/0253446 A1 Aug. 13, 2020

Related U.S. Application Data

(60) Provisional application No. 62/803,811, filed on Feb. 11, 2019.

(51) Int. Cl.
*A47L 9/28* (2006.01)
*A47L 5/28* (2006.01)

(52) U.S. Cl.
CPC ..... *A47L 9/2884* (2013.01); *A47L 5/28* (2013.01)

(58) Field of Classification Search
CPC ..... A47L 9/2884; A47L 9/2868; A47L 5/28
See application file for complete search history.

(56) References Cited

U.S. PATENT DOCUMENTS 5,014,386 A * 5/1991 Worwag ..... A47L 5/26 15/339
5,020,186 A * 6/1991 Lessig, III ..... A47L 5/30 15/339
5,233,722 A * 8/1993 McKnight ..... A47L 9/00 15/323
2016/0367093 A1 12/2016 VanTongeren
2018/0228327 A1* 8/2018 Samtani ..... A47L 9/2857
2018/0353026 A1 12/2018 Fogarty, Jr. et al.
2019/0357740 A1* 11/2019 Thorne ..... A47L 5/24

FOREIGN PATENT DOCUMENTS

CN 201641873 U 11/2010
CN 108742294 A 11/2018
DE 102016105687 A1 * 10/2017 ..... A47L 9/0411
EP 2988641 A1 3/2016
WO 2015077596 A1 5/2015

OTHER PUBLICATIONS

International Search Report and Written Opinion for Application No. PCT/US2020/017473 dated May 12, 2020 (14 pages).
Chinese Patent Office Action for Application No. 202080014690.X dated Feb. 15, 2022 (10 pages including statement of relevance).

* cited by examiner

*Primary Examiner* — Joseph J Hail
*Assistant Examiner* — J Stephen Taylor
(74) *Attorney, Agent, or Firm* — Michael Best & Friedrich LLP

(57) ABSTRACT

A vacuum cleaner including a base, a spine, a dust collection assembly, and a battery. The spine is connected to the base. The spine includes a handle portion and a mounting portion. The battery is connected to the mounting portion of the spine. The battery is pivotable between a first position in which the battery is fixedly connected to the spine, and a second position in which the battery is pivoted away from the spine. The dust collection assembly is connected to the spine.

25 Claims, 7 Drawing Sheets

BATTERY POWERED VACUUM CLEANER

CROSS-REFERENCE TO RELATED APPLICATIONS

This application claims priority to U.S. Provisional Patent Application No. 62/803,811 filed, Feb. 11, 2019, the entire contents of which are hereby incorporated by reference herein.

FIELD OF THE INVENTION

The present invention relates to vacuum cleaners, and more particularly to battery powered vacuum cleaners.

SUMMARY

A vacuum cleaner is disclosed including a base, a spine, a dust collection assembly, and a battery. The spine is connected to the base. The spine includes a handle portion and a mounting portion. The battery is connected to the mounting portion of the spine. The battery is pivotable between a first position in which the battery is fixedly connected to the spine, and a second position in which the battery is pivoted away from the spine. The dust collection assembly is connected to the spine.

Other features and aspects of the invention will become apparent by consideration of the following detained description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
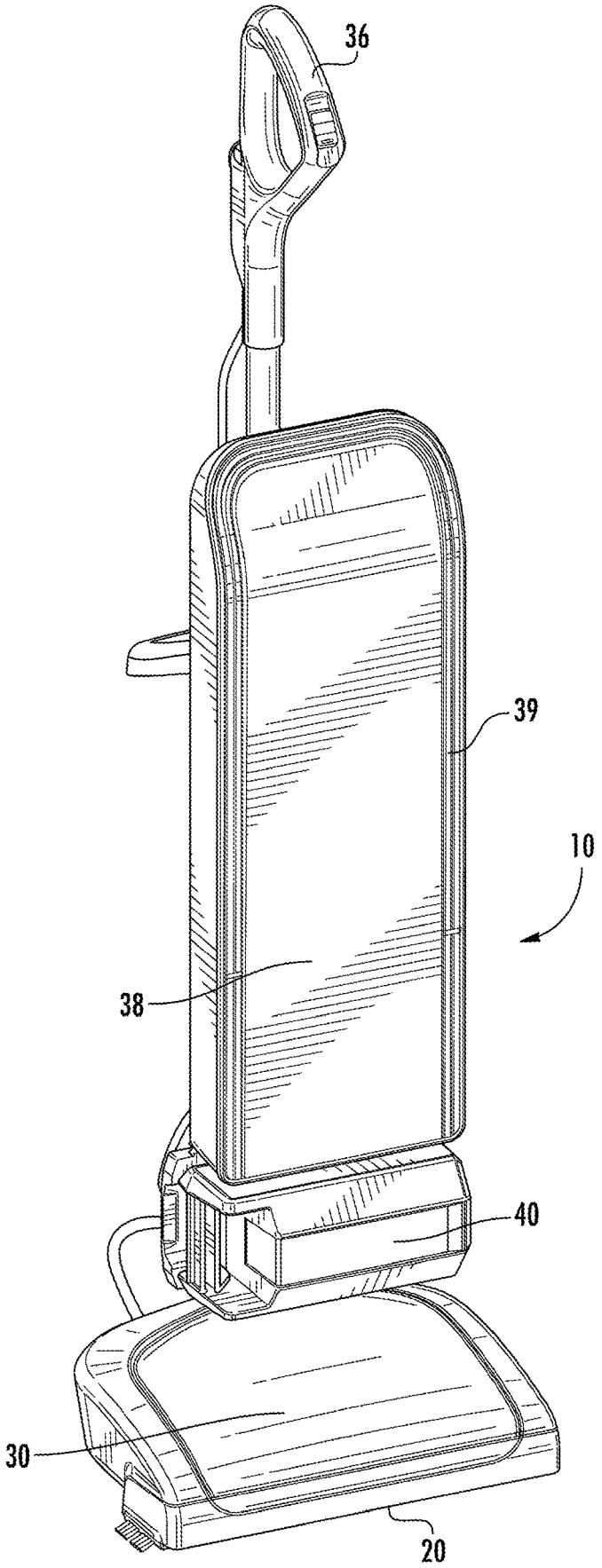
FIG. 1 is a perspective view of one embodiment of a vacuum cleaner.
Figure 2:
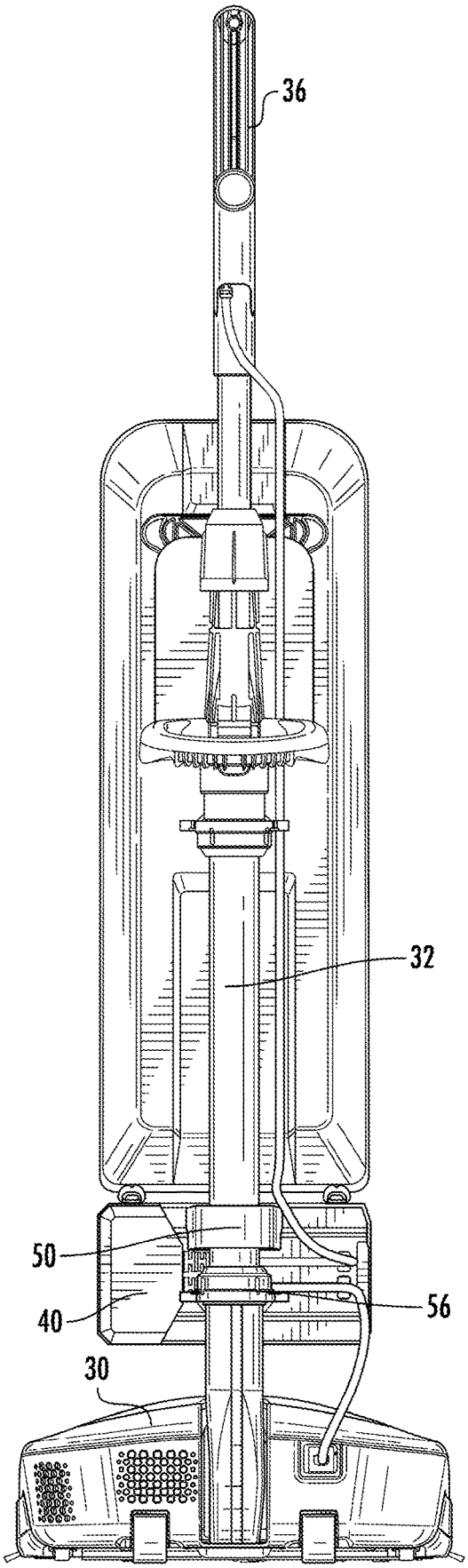
FIG. 2 is a rear view of one embodiment of a vacuum cleaner.
Figure 3:
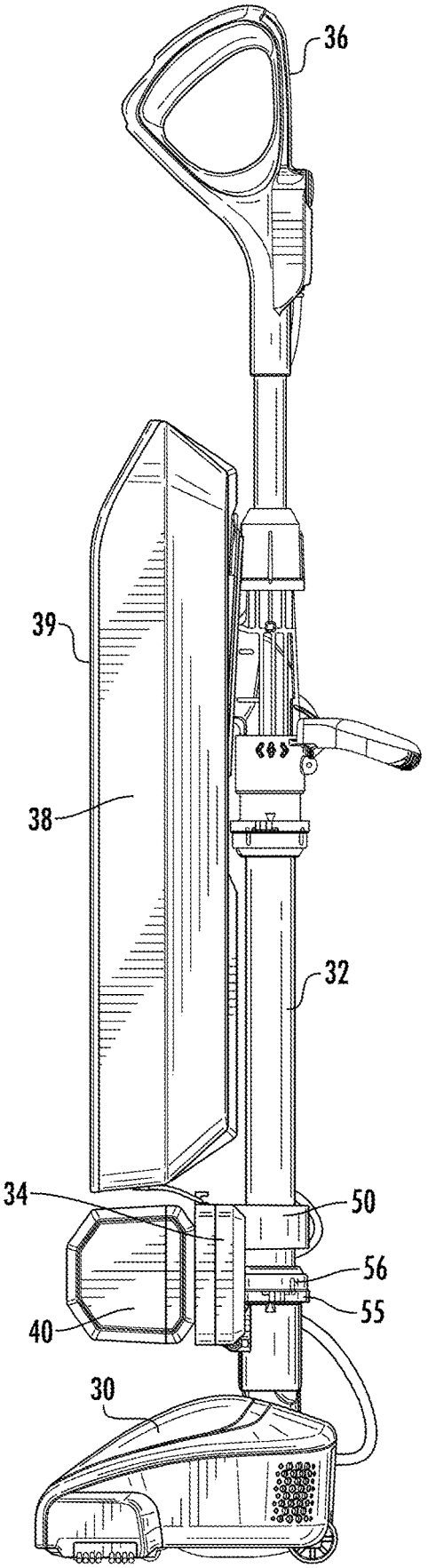
FIG. 3 is a side view of one embodiment of a vacuum cleaner with a battery in a first position.

FIG. 1 illustrates a vacuum cleaner 10 including a base 30, an upright portion or spine 32, and a mounting portion 34 for attaching a battery 40. As explained in further detail below, the battery 40 can move between a first position in which the battery 40 is fixedly connected to the base 30 or the spine 32 and a second position, shown in FIGS. 5-7, in which the battery 40 is moved away from the base 30 or the spine 32. When the battery 40 is in the second position, a user can access the base 30 or the spine 32 to perform maintenance or remove an obstruction from the vacuum cleaner 10, for example.

The spine 32 is pivotably coupled to the base 30 movable between an upright storage position and an inclined use position. The spine 32 includes a handle 36 opposite the base 30. The handle 36 is used to move the vacuum 10 back and forth over the surface to be cleaned. Further, the handle 36 allows a convenient place for a user to grip and lift the vacuum 10. In the illustrated embodiment, the spine 32 supports a dust collection assembly 38 between the handle 36 and the battery 40.

The vacuum cleaner 10 includes a suction motor assembly 42 (FIG. 5) operable to generate a suction airflow to draw air and debris into a suction inlet 20, along a dirty air flow conduit, and into the dust collection assembly 38. The suction motor assembly 52 may be disposed in the base 30 or in a motor housing disposed on the upright portion.

The dust collection assembly 38 is connected to the spine 32 between the base 30 and the handle 36. In one embodiment, the dust collection assembly 38 is a filter bag enclosed in an outer bag housing 39. In one embodiment, the dust collection assembly 38 includes a cyclonic separator. Collected debris is retained in the dust collection assembly 38 after traveling through the dirty air flow conduit. In one embodiment, the spine 32 includes the dirty air flow conduit such that dirty air travels from the base 30, through the spine 32, and to the dust collection assembly 38. In the illustrated embodiment, at least a portion of the outer bag housing 39 is air permeable providing exhaust of cleaned air. In some embodiments, the vacuum cleaner 10 may further include one or more filters for removing debris or odors from air. Such filters can include one or more wire, mesh, carbon, activated charcoal, filter paper, or HEPA filters.

Figure 4:
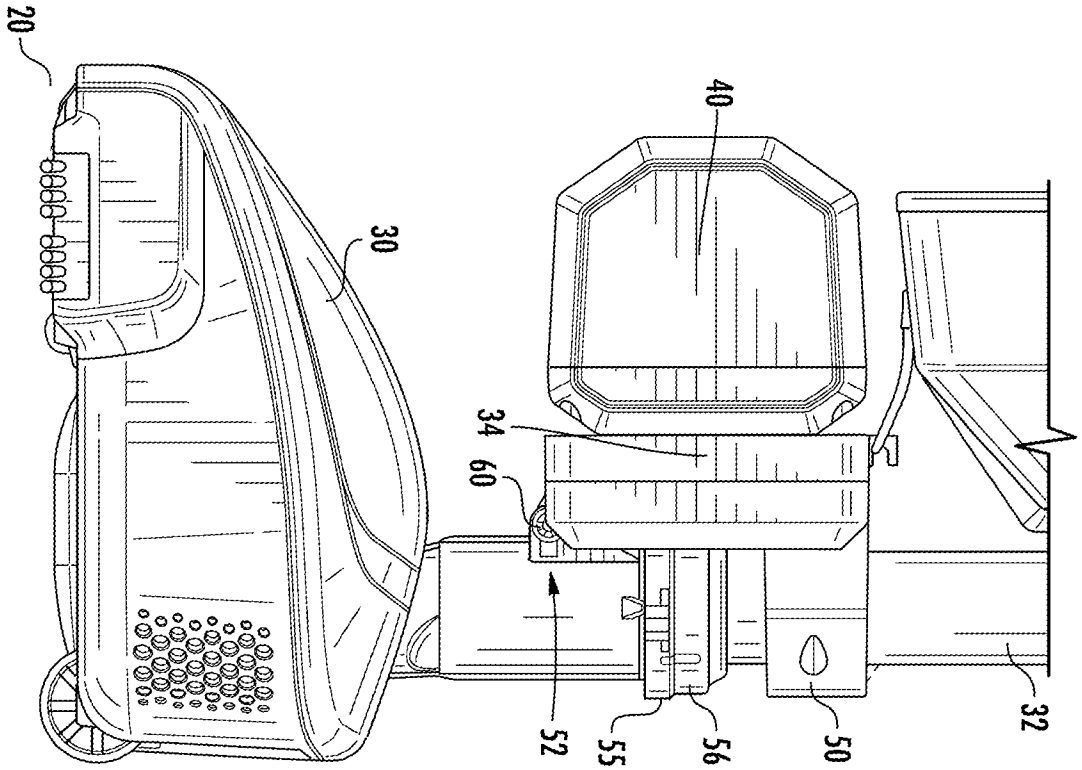
FIG. 4 is a side view of one embodiment of a vacuum cleaner with a battery in a first position.
Figure 5:
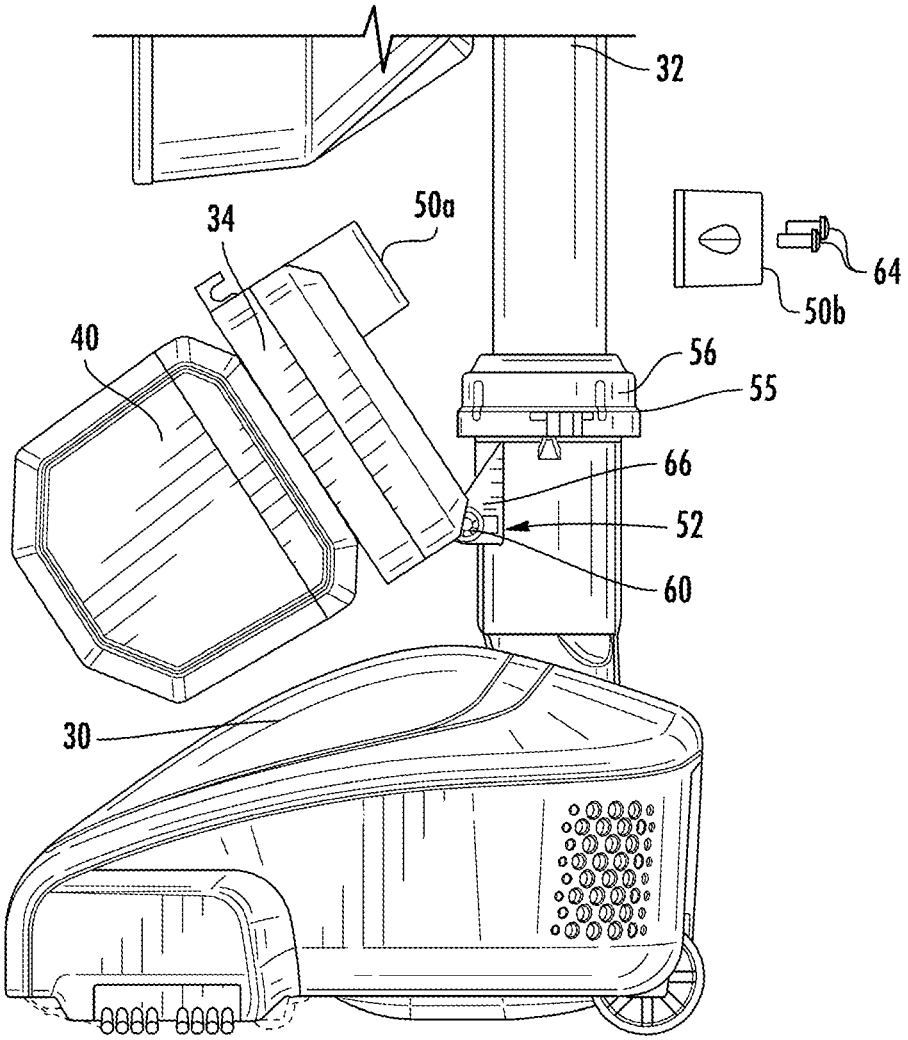
FIG. 5 is a partially exploded side view of one embodiment of a vacuum cleaner with a battery in a second position.
Figure 6:
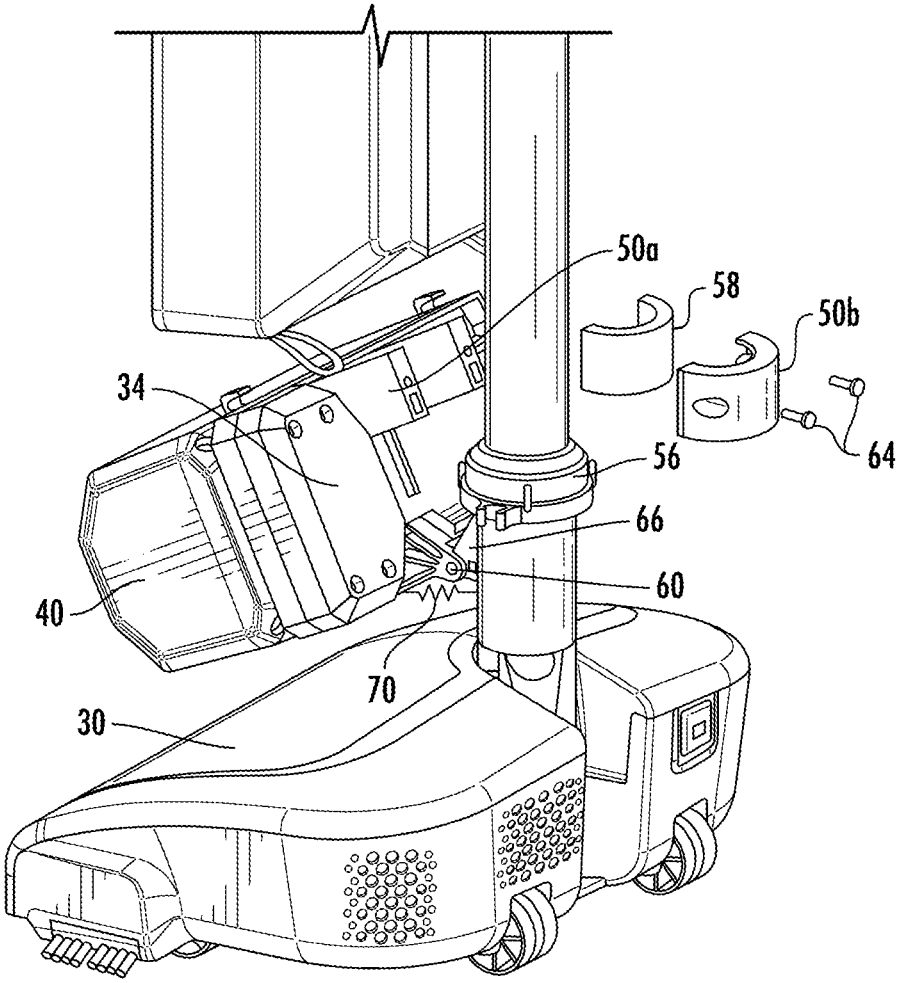
FIG. 6 is partially exploded perspective view of FIG. 5.
Figure 7:
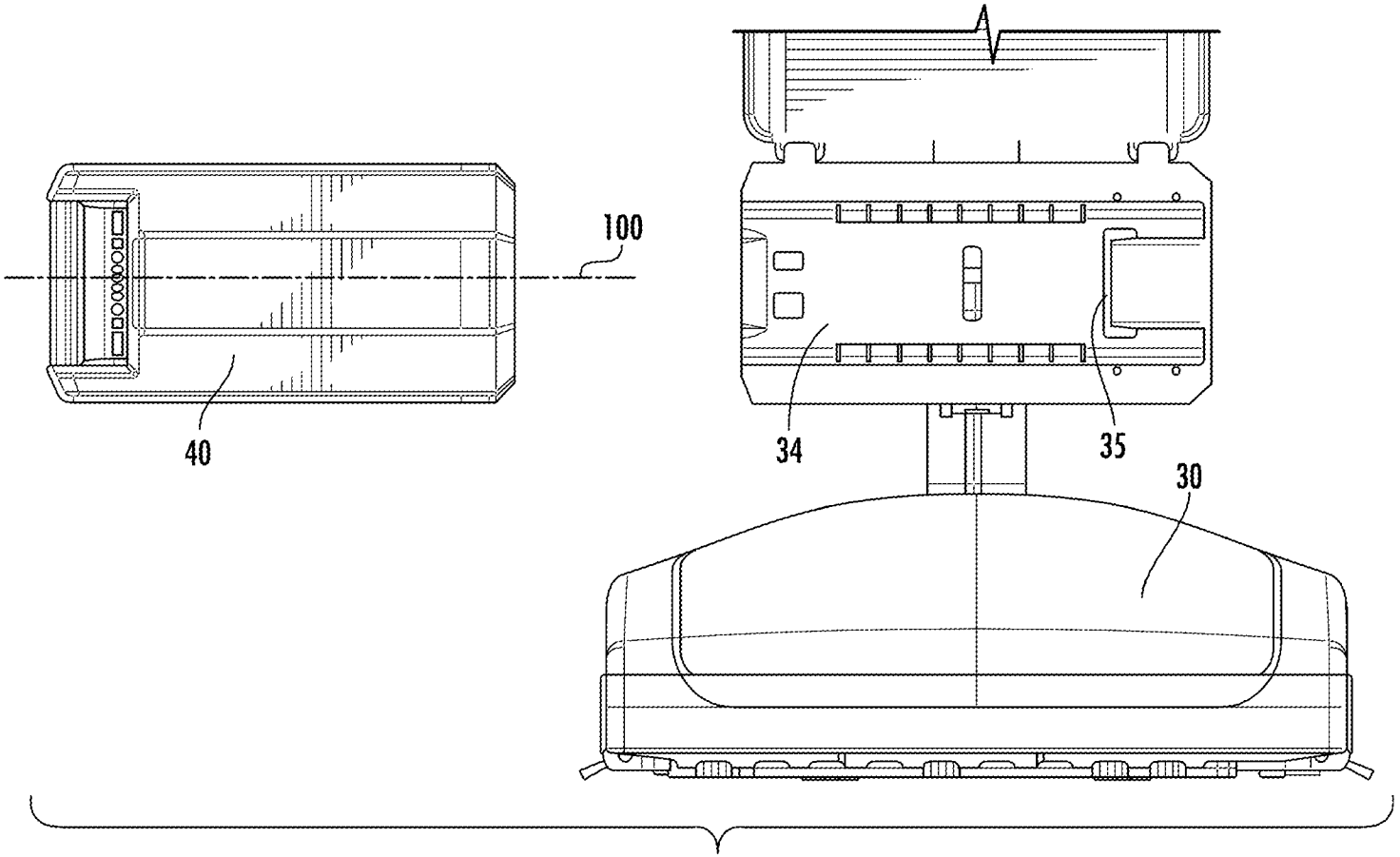
FIG. 7 is a partial front side view of the vacuum cleaner illustrating the battery removed.

The mounting portion 34 is described with reference to the illustrated embodiment as connected to the spine 32; however, in alternative embodiments the mounting portion 34 may be attached to the base 30. The mounting portion 34 is configured to receive and support the battery 40 of the vacuum cleaner 10. In one embodiment, the mounting portion 34 also includes an electrical battery connection 35 (FIG. 7) electrically connecting the battery 40 to the vacuum cleaner 10 to power the suction motor assembly. In other embodiments, the electrical battery connections 35 may be located on the spine 32 and the mounting portion 34 is used to move the battery 40 into and out of contact with the electrical battery connections 35. As shown in FIGS. 4-6, the mounting portion 34 includes a pivot connection or hinge 52 that is connected to the spine 32. The battery 40 pivot about the hinge 52, away from the spine 32, from the first position to the second position. The hinge 52 includes a hinge knuckle 62 mounted to one of the mounting portion 34 and the spine 32, and a bearing 66 on one or both sides of the hinge knuckle 62 mounted to the other of the mounting portion 34 and the spine 32. A hinge pin 60 supported by the bearing or bearings passes through the hinge knuckle 62 such that the mounting portion 34 pivots about the hinge pin 60 toward and away from the spine 32.

In the illustrated embodiment, the mounting portion 34 pivots between a first position in which the battery 40 is fixedly connected to the spine 32 and a second position in which the battery 40 is pivoted away from the spine 32. The mounting portion 34 or the spine 32 include a locking mechanism retaining the battery 40 in the first position. The locking mechanism may include one or more of a latch, snap, hook and loop fastener, zipper, magnet, friction fit, bayonet mount, or any other suitable locking member. In one embodiment, the mounting portion 34 and battery 40 are held in the first position by a locking mechanism on the hinge 52, such as a cam lever clamp, tab-detent interlock, bolt compression hinge, ratcheting pivot, or a suitable locking mechanism. In an alternative embodiment, the mounting portion 34 includes a second connection 50 holding the mounting portion 34 and battery 40 in the first position. This second connection 50 could be a clamp, latch, bolt, or another suitable connecting mechanism.

In the illustrated embodiment, the second connection 50 is a retainer having a first connection portion 50*a* and a second connection portion 50*b*, where the first connection portion 50*a* and the second connection portion 50*b* are movable between an open position and a closed position. When the mounting portion 34 is in its first position and the retainer is in the closed position, the first connection portion 50*a* and the second connection portion 50*b* engage the spine 32 inhibiting movement of the mounting portion 34 and the battery 40 connected to the spine 32. When the retainer is in the open position, the first connection portion 50*a* and the second connection portion 50*b* release the spine 32 allowing the mounting portion 34 to move to its second position pivoted away from the spine 32.

The first connection portion 50*a* and the second connection portion 50*b* may translate or rotate away from one another moving from the closed position to the open position. The first connection portion 50*a* and the second connection portion 50*b* may disconnect from one another as shown in FIGS. 5 and 6 to move from the closed position to the open position. Alternatively, the first connection portion 50*a* and the second connection portion 50*b* may remain connected together in the open position. The first connection portion 50*a* is connected to the mounting portion 34, and may be integral with the mounting portion 34. In the illustrated embodiment, the second connection portion 50*b* is connected to the first connection portion 50*a* in the closed position using fasteners 64 such as bolts or screws. In one embodiment, the second connection portion 50*b* is connected to the first connection portion 50*a* in the closed position using one or more latches. In one alternative, the second connection portion 50*b* is a latch.

The dirty air flow conduit in communication with the dust collection assembly 38 may be openable to perform maintenance or remove an obstruction from the vacuum cleaner 10, for example. In the illustrated embodiment, the spine 32 includes the dirty air flow conduit and the dirty air flow conduit is openable by a coupling 55 in the spine 32. The coupling 55 in the spine 32 is closed by a tube connector 56 that is releasable to open the conduit. As shown in FIGS. 4-6, the mounting portion 34 spans the coupling 55 in the spine 32, wherein the hinge 52 is located below the coupling when the spine 32 is in an upright position. Pivoting of the mounting portion 34 and battery 40 into the second position allows access to the coupling 55, enabling a user to release the tube connector 56 to open the conduit, such as to remove clogs in the spine 32 or the base 30 or perform other maintenance. The battery 40 pivots in a range from 30 degrees to 150 degrees between the first position and the second position.

In one embodiment, the mounting portion 34 and collar 50 include a non-slip material 58, such as neoprene, thermoplastic elastomer, rubber, or other non-slip material that inhibits the battery 40 from rotating about the spine 32 when the battery 40 is in the first position.

The battery 40 is mounted to the spine 32 adjacent the base 30. The position of the battery 40 near the base 30 of the vacuum cleaner 10 provides increased weight to the base 30, thereby improving suction efficiency of the vacuum cleaner 10. Further, the position of the battery 40 near the base 30 decreases the weight of the vacuum cleaner 10 that a user perceives when holding the handle 36 during use. In one embodiment, the battery 40 has a longitudinal axis 100 (FIG. 7) that is generally transverse to the spine 32. In the illustrated embodiment, the battery 40 is removable from the mounting portion 34 by sliding the battery 40 along the axis 100 relative to the mounting portion 34.

When the battery 40 is mounted to the spine 32 adjacent the base 30, the battery 40 in the second position may be in close proximity to the base 30 or the battery 40 may rest on the base 30 in the second position. A stop or tether may be provided holding the battery 40 in a desired orientation in the second position. In one embodiment, a counter spring 70, represented schematically in FIG. 6, is provided receiving at least a portion of the weight of the battery when the battery is in the second position. The counter spring 70 and the position of the spring may be configured to keep the full weight of the battery from impacting the base when moving from the first position to the second position, and may be configured to inhibit the battery 40 from touching the based in the second position. The counter spring may be a coil spring, torsion spring, leaf spring, elastomeric member, or other spring operatively connected between the mounting portion and the spine or base.

The various embodiments described above are provided by way of illustration only and should not be constructed to limit the invention. Those skilled in the art will readily recognize the various modifications and changes which may be made to the present invention without strictly following the exemplary embodiments illustrated and described herein, and without departing from the true spirit and scope of the present invention, which is set forth in the following claims.

What is claimed is:

1. A vacuum cleaner comprising:

a base;

a spine pivotally connected to the base, the spine including a handle portion and an air flow conduit, the air flow conduit including a coupling, the air flow conduit openable by the coupling to separate the handle portion from the base;

a mounting portion pivotally connected to the spine;

a battery connected to the mounting portion wherein the battery and the mounting portion are pivotable between a first position in which the battery and the mounting portion are fixedly connected to the spine and a second position in which the battery and the mounting portion are pivoted away from the spine so that the coupling of the air flow conduit is accessible; and a dust collection assembly connected to the spine and in fluid communication with the air flow conduit;

wherein when the air flow conduit is opened and the handle portion is separated from the base, the mounting portion remains with the base.

2. The vacuum cleaner of claim 1 wherein the mounting portion is connected to the spine by a hinge, and where the mounting portion and the battery pivot away from the spine about the hinge.

3. The vacuum cleaner of claim 2 wherein the hinge is positioned below the coupling, closer to the base than to the handle portion, and the mounting portion and the battery pivot away from the coupling.

4. The vacuum cleaner of claim 2 wherein the mounting portion includes a lock retaining the mounting portion in the first position.

5. The vacuum cleaner of claim 4 wherein the lock is a collar retaining the mounting portion to the spine.

6. The vacuum cleaner of claim 5 wherein the collar further comprises a non-slip material inhibiting the battery from rotating about the spine when the battery is in the first position.

7. The vacuum cleaner of claim 1 where the mounting portion spans the coupling in the air flow conduit.

8. The vacuum cleaner of claim 1 wherein the mounting portion further comprises an electrical battery connection.

9. The vacuum cleaner of claim 1 wherein the battery has a longitudinal axis that is transverse to the spine in both the first position and the second position of the battery and the mounting portion.

10. The vacuum cleaner of claim 1 wherein the battery is mounted to the spine adjacent the base, so that the battery is closer to the base than to the handle portion.

11. The vacuum cleaner of claim 10 further comprising a counter spring receiving at least a portion of the weight of the battery when the battery is in the second position.

12. The vacuum cleaner of claim 1, wherein the coupling includes a connector operable to open the air flow conduit.

13. The vacuum cleaner of claim 1, wherein the battery can be uncoupled from the mounting portion without moving the mounting portion and the battery to the second position.

14. The vacuum cleaner of claim 1, wherein in the first position a top of the mounting portion is secured to the air flow conduit above the coupling and a bottom of the mounting portion is secured to the air flow conduit below the coupling.

15. A vacuum cleaner comprising:

a body including an airflow conduit in communication with a dust collection assembly;

a base pivotally attached to the body;

a mounting portion attached to the body adjacent the base and spanning a coupling in the airflow conduit;

a battery connected to the mounting portion wherein the battery and the mounting portion are pivotable between a first position in which the battery is fixedly connected to the body and a second position in which the battery is pivoted away from the body toward the base and the coupling of the airflow conduit is accessible, wherein the battery can be uncoupled from the mounting portion without moving the mounting portion and the battery to the second position;

a suction motor powered by the battery operable to generate a suction airflow through the airflow conduit.

16. The vacuum cleaner of claim 15 wherein the mounting portion is connected to the airflow conduit by a hinge, and where the mounting portion and the battery pivot away from the airflow conduit about the hinge.

17. The vacuum cleaner of claim 15, wherein the coupling includes a connector operable to open the airflow conduit.

18. The vacuum cleaner of claim 17, wherein the mounting portion prevents operation of the connector and therefore prevents opening of the coupling when the battery and the mounting portion are in the first position.

19. The vacuum cleaner of claim 15, wherein in the first position a top of the mounting portion is secured to the airflow conduit above the coupling and a bottom of the mounting portion is secured to the airflow conduit below the coupling.

20. A vacuum cleaner comprising:

a base;

a spine pivotally connected to the base and including a handle, the spine defining an air flow conduit including a coupling;

a mounting portion directly mounted to the air flow conduit for pivotal movement relative to the air flow conduit, the mounting portion mounted closer to the base than the handle;

a battery connected to the mounting portion, wherein the battery and the mounting portion are pivotable between a first position in which the battery and mounting portion are adjacent the air flow conduit and a second position in which the battery and mounting portion are pivoted away from the air flow conduit so that the coupling is accessible.

21. The vacuum cleaner of claim 20, wherein the battery can be uncoupled from the mounting portion without rotating the mounting portion and the battery to the second position.

22. The vacuum cleaner of claim 20, wherein the coupling includes a connector operable to open the air flow conduit.

23. The vacuum cleaner of claim 22, wherein opening the air flow conduit separates the handle from the base.

24. The vacuum cleaner of claim 20, wherein in the first position a top of the mounting portion is secured to the air flow conduit above the coupling and a bottom of the mounting portion is secured to the air flow conduit below the coupling.

25. The vacuum cleaner of claim 24, wherein the top of the mounting portion is securable to the air flow conduit via a collar lock and wherein the bottom of the mounting portion is secured to the air flow conduit via a hinge.

* * * * *